US005113203A

United States Patent [19]

Takagi et al.

[11] Patent Number: 5,113,203

[45] Date of Patent: May 12, 1992

[54] LIQUID JET HEAD, SUBSTRATE FOR SAID HEAD AND LIQUID JET APPARATUS HAVING SAID HEAD

[75] Inventors: Hiroshi Takagi, Yokohama; Atsushi Shiozaki, Isehara, both of Japan

[73] Assignee: Canon Kabushiki Kaisha, Tokyo, Japan

[21] Appl. No.: 742,728

[22] Filed: Aug. 6, 1991

Related U.S. Application Data

[63] Continuation of Ser. No. 643,681, Jan. 23, 1991, abandoned, which is a continuation of Ser. No. 512,561, Apr. 25, 1990, abandoned, which is a continuation of Ser. No. 278,492, Dec. 1, 1988, abandoned.

[30] Foreign Application Priority Data

Dec. 1, 1987 [JP] Japan ..... 62-303712

[51] Int. Cl.[5] ..... B41J 2/05; H01C 1/012

[52] U.S. Cl. ..... 346/140 R; 338/314

[58] Field of Search ..... 346/140 PD

[56] References Cited

U.S. PATENT DOCUMENTS

| | | | |
|---|---|---|---|
| 4,296,421 | 10/1981 | Hara et al. . | |
| 4,335,389 | 6/1982 | Shirato et al. | 346/140 R |
| 4,336,548 | 6/1982 | Matsumoto | 346/140 R |
| 4,392,907 | 7/1983 | Shirato et al. . | |
| 4,450,457 | 5/1984 | Miyachi et al. . | |
| 4,567,493 | 1/1986 | Ikeda et al. | 346/140 R |
| 4,577,202 | 3/1986 | Hara . | |
| 4,596,994 | 6/1986 | Matsuda et al. | 346/140 R |
| 4,686,544 | 8/1987 | Ikeda et al. | 346/140 R |
| 4,720,716 | 1/1988 | Ikeda et al. | 346/140 R |
| 4,725,859 | 2/1988 | Shibata et al. . | |
| 4,737,803 | 4/1988 | Fujimora et al. | 346/140 R |
| 4,847,639 | 7/1989 | Sugata et al. | 346/140 R |
| 4,936,952 | 6/1990 | Komuro | 346/140 R X |

FOREIGN PATENT DOCUMENTS

| | | |
|---|---|---|
| 3446968 | 7/1985 | Fed. Rep. of Germany . |
| 3618533 | 12/1986 | Fed. Rep. of Germany . |
| 3618596 | 12/1986 | Fed. Rep. of Germany . |
| 128467 | 10/1980 | Japan . |
| 194866 | 11/1984 | Japan . |

*Primary Examiner*—George H. Miller, Jr.
*Attorney, Agent, or Firm*—Fitzpatrick, Cella, Harper & Scinto

[57] ABSTRACT

A liquid jet head comprises, an electrothermal transducer having a heat-generating resistor formed using an amorphous alloy containing at least one selected from the group consisting of Ti, Zn, Hf, Nb, Ta and W as well as Fe, Ni and Cr, and a pair of electrodes connected electrically to said heat-generating resistor, a support for supporting said electrothermal transducer and a liquid path formed on said support corresponding to the heat generating portion of said electrothermal transducer formed between said pair of electrodes and communicated to a discharge opening for discharging ink.

110 Claims, 2 Drawing Sheets

LIQUID JET HEAD, SUBSTRATE FOR SAID HEAD AND LIQUID JET APPARATUS HAVING SAID HEAD

This application is a continuation of application Ser. No. 643,681 filed Jan. 23, 1991, now abandoned which in turn is a continuation of application Ser. No. 512,561 filed Apr. 25, 1990, now abandoned, which in turn is a continuation of application Ser. No. 278,492 filed Dec. 1, 1988, now abandoned.

BACKGROUND OF THE INVENTION

1. Field of the Invention

This invention relates to a liquid jet recording head which performs recording by discharging liquid for recording such as ink, etc. by utilizing heat energy to form its droplets and attaching the droplets onto a recording medium such as a paper, to a substrate for the head and to a liquid jet apparatus having the head.

2. Related Background Art

Recording head to be used for the liquid jet recording method which utilizes heat energy for formation of droplets to be discharged generally comprises a discharge opening for discharging liquid for recording such as ink, etc.; a liquid path communicated to the discharge opening having a portion at which heat energy to be utilized for discharging liquid acts on liquid and an electrothermal transducer which is a heat energy generating means for generating the heat energy having a heat-generating resistor and a pair of electrodes connected to the heat-generating resistor, and has, for example, a structure shown in a separated state in the schematic perspective views of FIG. 2.

Among the recording heads having such constitution for example, the recording head disclosed in Japanese Laid-open Patent Application No. 55-126462, as shown in FIG. 1, consisted of a heat-generating resistor 208 for generating heat energy on a surface of support, electrodes 209, 210 for supplying electrical signals thereto formed by lamination according to thin film forming technique, etc. to form a substrate 202 for recording head, and further a liquid path 204 in contact with the heat-generating portion 201 of the heat generating resistor 208 and a discharge opening 217 formed on the substrate.

One of the specific feature of the recording head resided in that no protective layer as seen in the prior art was laminated on at least the upper part of the heat-generating portion 201 of the heat-generating resistor 208, thus having a structure in which the heat energy generated by the heat-generating portion 201 of the heat-generating resistor 208 can be readily transmitted directly to the liquid in the liquid path 204.

If electrodes 209, 210 are made of a corrosion resistant material such as gold, it is not required to provide protective layer 213, 214 thereon, but when they are formed of a readily corrosive material such as Al, it is preferable that protective layers 213, 214 comprising an inorganic insulating material such as $SiO_2$, SiN, etc. or a heat-resistant organic polymer such as polyimide, etc. as shown in the Figure at the portions other than the heat-generating portion 201 of the heat-generating resistor 208.

As the material for forming the heat-generating resistor 208 of the recording head of such constitution, there have been used in the art materials exhibiting appropriate resistance values, specifically, noble metals (elements of the group VIII, etc.), high melting transition elements (elements of the groups III, IV, V, VI, etc.), alloys of these, or nitrides, borides, silicides, carbides of oxides of these metals, and further silicon-diffused resistors, or amorphous films composed mainly of carbon, etc.

In the recording head of the constitution having no protective layer provided on the heat-generating resistor as described above, its durable life depends greatly on the performance of the heat-generating resistor.

Shortly speaking, since the heat-generating resistor layer is subject to heat for gasification of liquid, and cavitation shock created during droplet dischargigng and chemical action of liquid, it must be excellent in heat resistance, breaking resistance, liquid resistance, oxidation resistance, etc.

Whereas, no material for formation of heat-generating resistor satisfying all of these requirements has been known in the art.

For example, single substance metals of noble metals, high melting transition metals, etc. have generally low specific resistance to pose a problem in the point of heat-generating efficiency, while in nitrides, borides, silicides, carbides, oxides of the above metals, or silicon-diffused resistors, or amorphous films composed mainly of carbon etc., there is sometimes the drawback of weak resistance to mechanical shock by cavitation shock, which may be estimated to be due to the fact that the atomic bonds of such compounds are covalent bonding in nature.

Also, crystalline or polycrystalline alloys were sometimes insufficient in chemical stability.

SUMMARY OF THE INVENTION

The present inventors, in order to solve the above problems, have made various investigations about the material for formation of heat-generating resistor satisfying the requirements as described above and consequently found a material which can satisfy all of the above requirements to accomplish the present invention.

An object of the present invention is to provide a liquid jet recording head having a heat-generating resistor excellent in impact resistance, heat resistance, breaking resistance, liquid resistance, oxidation resistance, etc., a substrate for the head and a liquid jet recording apparatus having the head.

Another object of the present invention is to provide a liquid jet head comprising:

an electrothermal transducer having a heat-generating resistor formed using an amorphous alloy containing at least one selected from the group consisting of Ti, Zn, Hf, Nb, Ta and W as well as Fe, Ni and Cr, and a pair of electrodes connected electrically to said heat-generating resistor;

a support for supporting said electrothermal transducer; and a liquid path formed on said support corresponding to the heat generating portion of said electrothermal transducer formed between said pair of electrodes and communicated to a discharge opening for discharging ink.

Still another object of the present invention is to provide a substrate for liquid jet head comprising:

an electrothermal transducer having a heat-generating resistor formed using an amorphous alloy containing at least one selected from the group consisting of Ti, Zn, Hf, Nb, Ta and W as well as Fe, Ni and Cr, and a pair of electrodes connected electrically to said heat-generating resistor; and a support for supporting said electrothermal transducer.

Still another object of the present invention is to provide a liquid jet apparatus having the aforesaid liquid jet head.

DETAILED DESCRIPTION OF THE PREFERRED EMBODIMENTS

The composition of the amorphous alloy to be used to form the heat-generating resistor of the present invention is represented by:

$$M_x(Fe_{100-y-z}Ni_yCr_z)_{100-x}$$

wherein x is selected such that the alloy may be amorphous, at the value x, for example, in the range of 10 to 70 atomic %, preferably 20 to 70.

On the other hand, y should be desirably made 5 to 30 atomic % and z 10 to 30 atomic %.

M represents at least one selected from the group consisting of Ti, Zr, Hf, Nb, Ta and W. That is, these elements may be used either singly or in a plural number thereof, as desired.

The amorphous alloy film represented by the above compositional formula has high specific resistance, 150–300 μohm.cm, and excellent properties as the constituent material of the heat-generating resistor directly in contact with liquid such as heat resistance, corrosion resistance, mechanical strength, etc.

For formation of the layer of the heat-generating resistor (one shown by 208 in FIG. 1) by use of the amorphous alloy film, conventional thin film deposition techniques, etc. may be applicable, but the sputtering method is suitable from the standpoint of obtaining readily a highly dense and strong amorphous alloy film.

Also, by heating the support during formation of the film to 100° to 200° C., strong adhesive force can be obtained.

Figure 1:
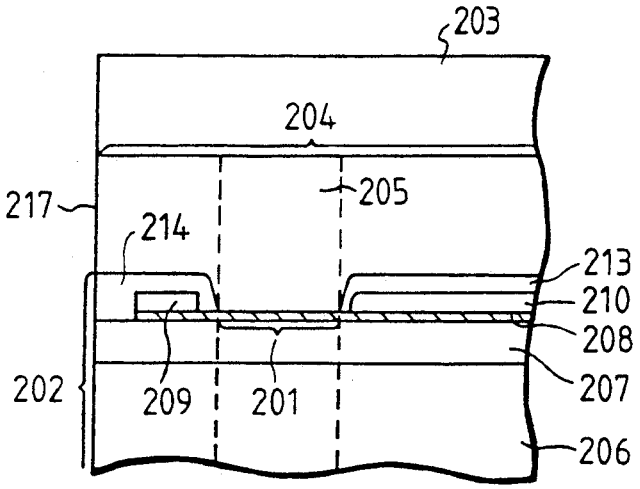
FIG. 1 is a partial sectional view showing the structure of the principal part of the liquid recording head, FIG. 2 a perspective view showing the structure of the principal part of the liquid jet recording head in a separated state, FIG. 3 the Weibull plot representing the results of durability tests of the liquid jet recording heads obtained in Examples and Comparative examples and FIG. 4 a schematic perspective view showing the appearance of the liquid jet apparatus equipped with the liquid jet head of the present invention.
Figure 2:
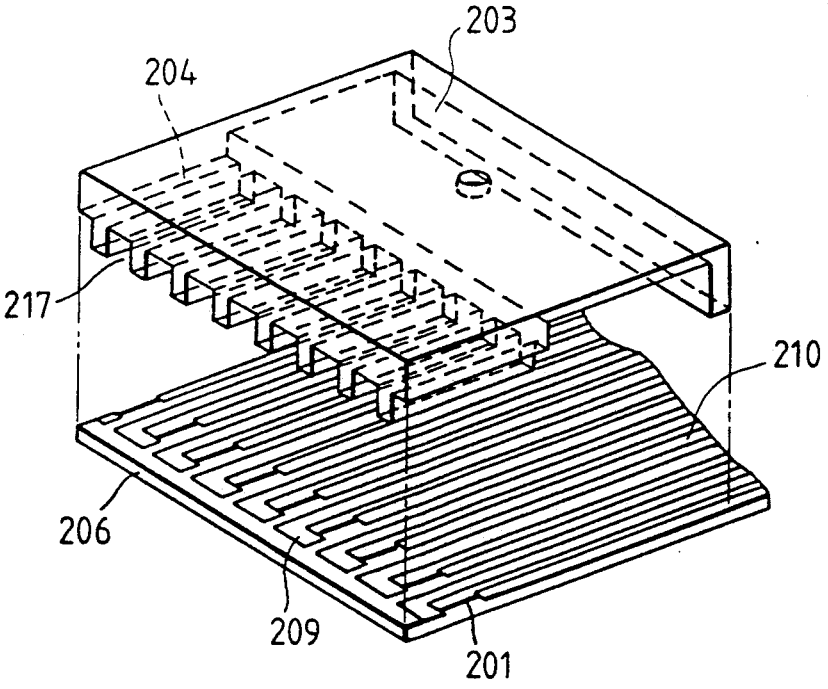

The constitutions of the liquid jet recording head of the present invention are not limited to the constitution as shown in FIG. 1 and FIG. 2, but they may have any desired constitutions.

For example, various protective layers as described above may be also used as provided on the heat-generating portion.

Also, in the liquid jet head of the present invention, the direction of ink supply to the heat generating portion of the liquid path may be substantially same as or different from (e.g. forming substantially a right angle with) the direction of ink discharge.

Further, in the liquid jet head of the present invention, the layer of heat generating resistor and the layer of electrode may be provided in a reverse (upset) arrangement.

In addition, the liquid jet head may be of a so-called full line type which has discharge openings over the whole range of the recording width of receiving material.

The present invention is described in more detail below by referring to Examples and Comparative examples.

EXAMPLE 1

By use of an Si wafer having an $SiO_2$ film of 5 μm as the heat accumulating layer, lower layer 207, provided on its surface by the heat oxidation treatment as support 206, $Ta_{50}(Fe_{73}Ni_{10}Cr_{17})_{50}$ was formed as the heat-generating resistor layer on the lower layer 207 at a support temperature of 100° C. according to the sputtering method to a film thickness of 2400 Å, followed further by film formation of Al layer with a thickness of 5000 Å by sputtering.

Next, the Al layer and the heat-generating resistor layer were subjected to patterning according to the photolithographic steps to a desired shape as shown in FIG. 2 to form an electrothermal transducer having a heat-generating resistor 208 and a pair of electrodes 209, 210.

Further, on the electro-thermal transducer were spin coated photosensitive polyimide (Photoniece, produced by Toray) as the protective layers 213, 214, which were then subjected to patterning to a predetermined shape.

On the plate-shaped substrate 202 provided with an electrothermal transducer as described above, a covering member of glass plate 203 having a groove to form the liquid path 204 was laminated through an epoxy type adhesive to obtain a liquid jet recording head having the constitution primarily as shown in FIG. 1 and FIG. 2.

EXAMPLE 2

A recording head was prepared in the same manner as in Example 1 except for forming by sputtering $Ti_{25}(Fe_{73}Ni_{10}Cr_{17})_{75}$ with a thickness of 2300 Å as the heat-generating resistor layer.

EXAMPLE 3

A recording head was prepared in the same manner as in Example 1 except for forming by sputtering $Zr_{28}(Fe_{73}Ni_{10}Cr_{17})_{72}$ with a thickness of 2000Å as the heat-generating resistor layer.

EXAMPLE 4

A recording head was prepared in the same manner as in Example 1 except for forming by sputtering $Hf_{28}(Fe_{73}Ni_{10}Cr_{17})_{72}$ with a thickness of 2100 Å as the heat generating resistor layer.

EXAMPLE 5

A recording head was prepared in the same manner as in Example 1 except for forming by sputtering $Nb_{56}(Fe_{68}Ni_{11}Cr_{21})_{44}$ with a thickness of 2400 Å as the heat-generating resistor layer.

EXAMPLE 6

A recording head was prepared in the same manner as in Example 1 except for forming by sputtering $W_{31}(Fe_{68}Ni_{11}Cr_{21})_{69}$ with a thickness of 2100 Å as the heat-generating resistor layer.

EXAMPLE 7

A recording head was prepared in the same manner as in Example 1 except for forming by sputtering $Ta_{32}Ti_{18}(Fe_{73}Ni_{10}Cr_{17})_{50}$ with a thickness of 1900 Å as the heat-generating resistor layer.

EXAMPLE 8

A recording head was prepared in the same manner as in Example 1 except for forming by sputtering $Nb_{28}Zr_{20}(Fe_{73}Ni_{10}Cr_{17})_{52}$ with a thickness of 2200 Å as the heat-generating resistor layer.

EXAMPLE 9

A recording head was prepared in the same manner as in Example 1 except for forming by sputtering $Hf_{35}W_{22}(Fe_{73}Ni_{10}Cr_{17})_{43}$ with a thickness of 1800 Å as the heat-generating resistor layer.

EXAMPLE 10

A recording head was prepared in the same manner as in Example 1 except for forming by sputtering $Ta_{40}Ti_{13}Nb_{11}(Fe_{73}Ni_{10}Cr_{17})_{36}$ with a thickness of 2000 Å as the heat-generating resistor layer.

EXAMPLE 11

A substrate for a liquid jet head and a liquid jet head formed by use of the substrate of the present invention was prepared in the same manner as in Example 1 except for adding a step to form a protective layer of $SiO_2$ on an electro-thermal transducer before providing the protective layers 213, 214.

Also in this example, the substrate for the liquid jet head and the liquid jet head formed by use of the substrate having various excellent properties such as durability etc. could be prepared.

EXAMPLE 12

A substrate for liquid jet head and a liquid jet head formed by use of the substrate of the present invention was prepared in the same manner as in Example 2 except for adding a step to form a protective layer of SiN on an electro-thermal transducer before providing the protective layer 213, 214.

Also in this example, the substrate for the liquid jet head and the liquid jet head formed by use of the substrate having various excellent properties such as durability etc. could be prepared.

COMPARATIVE EXAMPLE 1

A recording head was prepared in the same manner as in Example 1 except for forming by sputtering $HfB_2$ with a thickness of 2500 Å as the heat-generating resistor layer.

COMPARATIVE EXAMPLE 2

A recording head was prepared in the same manner as in Example 1 except for forming by sputtering $Ti_9(Fe_{73}Ni_{10}Cr_{17})_{91}$ with a thickness of 2400 Å as the heat-generating resistor layer.

The film having this composition was analyzed by X-ray diffractometry to be a polycrystalline film.

By use of the recording heads obtained in Example 1 to 6 and Comparative examples 1, 2 respectively, recording was performed by use of ink for liquid jet recording under the following conditions for testing of its durability.

Recording conditions: with the driving pulse being made 2 KHz, 5 μsec., the applied energy was made 1.3-fold of the liquid jet threshold value energy.

Figure 3:
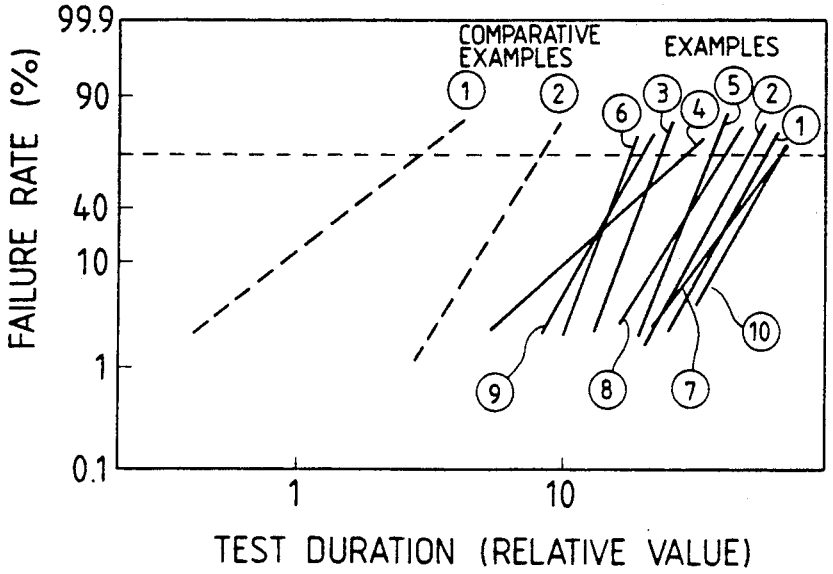

FIG. 3 shows the Weibull plot of failure rate prepared from the results obtained. The time point when the resistance value of the heat-generating resistor exceeded 120% of the initial value was deemed as failure.

As is also apparent from FIG. 3, the recording heads of the present invention of Examples 1 to 6 were all found to have longer life relative to the recording head prepared in Comparative examples 1,2.

Furthermore, in the present invention, the liquid path of the liquid jet head may be formed by forming first a wall forming member of the liquid path by use of, for example, a photosensitive resin and then bonding a top plate to the wall forming member.

Figure 4:
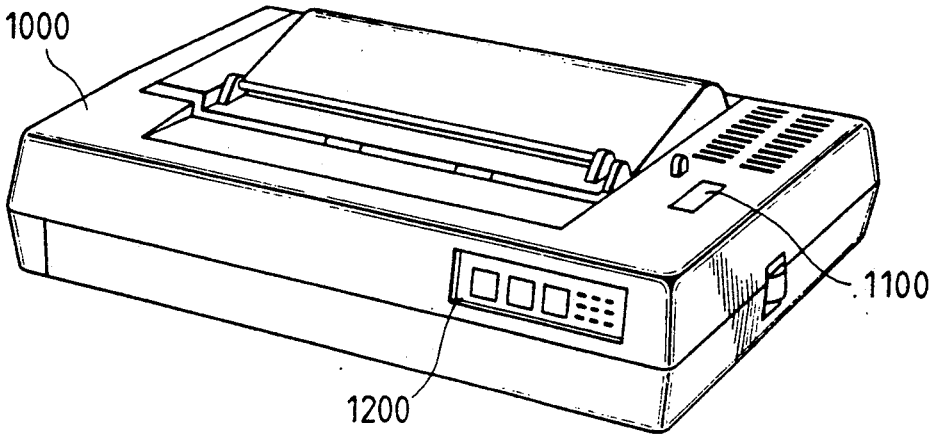

FIG. 4 is a schematic perspective view showing the appearance of a liquid jet apparatus equipped with the liquid jet head of the present invention. In FIG. 4, 1000 is the apparatus body, 1100 a power switch, 1200 an operation panel.

As described in detail above, the recording head formed by use of the substrate for liquid jet heads of the present invention, by use of an amorphous alloy film having the specific composition as the heat-generating resistor as described above, has sufficient durability, even when it is made a constitution having no protective film on the heat-generating resistor.

Thus, a recording head capable of effecting thermal conduction to liquid with good efficiency, which can be used with smaller power consumption and is excellent in durability can be provided by the present invention.

We claim:

1. An ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, a heat-generating portion being formed by said heat generating resistor between said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and x is 10–30;

a support for said electrothermal transducer; and a liquid path formed on said support corresponding to the heat-generating portion of said electrothermal transducer, said liquid path communicating with a discharge opening for discharging liquid.

2. An ink jet head according to claim 1, wherein said amorphous alloy is represented by $$M_x(Fe_{100-y-z}Ni_yCr_z)_{100-x}$$

wherein M is at least one selected from Ti, Zr, Hf, Nb, Ta and W, and x is 20–70.

3. An ink jet head according to claim 1, wherein said amorphous alloy is $Ta_{50}(Fe_{73}Ni_{10}Cr_{17})_{50}$.

4. An ink jet head according to claim 1, wherein said amorphous alloy is $Ti_{25}(Fe_{73}Ni_{10}Cr_{17})_{75}$.

5. An ink jet head according to claim 1, wherein said amorphous alloy is $Zr_{28}(Fe_{73}Ni_{10}Cr_{17})_{72}$.

6. An ink jet head according to claim 1, wherein said amorphous alloy is $Hf_{28}(Fe_{73}Ni_{10}Cr_{17})_{72}$.

7. An ink jet heat according to claim 1, wherein said amorphous alloy is $Nb_{56}(Fe_{68}Ni_{11}Cr_{21})_{44}$.

8. An ink jet head according to claim 1, wherein said amorphous alloy is $W_{31}(Fe_{68}N_{11}Cr_{21})_{69}$.

9. An ink jet head according to claim 1, wherein said amorphous alloy is $Ta_{32}Ti_{18}(Fe_{73}Ni_{10}Cr_{17})_{50}$.

10. An ink jet head according to claim 1, wherein said amorphous alloy is $Nb_{28}Zr_{20}(Fe_{73}Ni_{10}Cr_{17})_{52}$.

11. An ink jet head according to claim 1, wherein said amorphous alloy is $Hf_{35}W_{22}(Fe_{73}Ni_{10}Cr_{17})_{43}$.

12. An ink jet head according to claim 1, wherein said amorphous alloy is $Ta_{40}Ti_{13}Nb_{11}(Fe_{73}Ni_{10}Cr_{17})_{36}$.

13. An ink jet head according to claim 1, wherein the specific resistance of said heat-generating resistor is 150–300 μohm.cm.

14. An ink jet head according to claim 1, wherein said heat-generating resistor is formed between said support and said electrode.

15. An ink jet head according to claim 1, wherein said electrode is formed between said support and said heat-generating resistor.

16. An ink jet head according to claim 1, wherein said electrothermal transducer generates heat energy used for discharging liquid.

17. An ink jet head according to claim 1, wherein the direction of liquid discharge from said discharge opening is substantially same as the direction of ink supply to said heat-generating portion.

18. An ink jet head according to claim 1, wherein the direction of liquid discharge from said discharge opening is different from the direction of ink supply to said heat-generating portion.

19. An ink jet head according to claim 18, wherein said two directions form substantially right angle.

20. An ink jet head according to claim 1, wherein said discharge opening is provided in a plural number.

21. An ink jet head according to claim 1, wherein said discharge opening is provided in a plural number corresponding to the width of recording medium.

22. An ink jet head according to claim 1, wherein the member for forming said liquid path on said support is a covering member having a groove for forming said liquid path.

23. An ink jet head according to claim 1, wherein the member for forming said liquid path on said support comprises a wall-forming member forming the wall of said liquid path and a top plate bonded to said wall-forming member.

24. An ink jet head according to claim 23, wherein said wall-forming member is formed using a photosensitive resin.

25. An ink jet head according to claim 1, wherein said protective layer is formed on said electrothermal transducer.

26. An ink jet head according to claim 25, wherein said protective layer is formed by use of $SiO_2$.

27. An ink jet head according to claim 25, wherein said protective layer is formed by use of SiN.

28. An ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and y is 5–30;

a support for said electrothermal transducer; and a liquid path formed on said support corresponding to the heat-generating portion of said electrothermal transducer, said liquid path communicating with a discharge opening for discharging liquid.

29. An ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and z is 10–30;

a support for said electrothermal transducer; and a liquid path formed on said support corresponding to the heat-generating portion of said electrothermal transducer, said liquid path communicating with a discharge opening for discharging liquid.

30. An ink jet head substrate comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, wherein said amorphous alloy is represented by $$M_x(Fe_{100-y-z}Ni_yCr_z)_{100-x}$$

wherein M is at least one selected from Ti, Zr, Hf, Nb, Ta and W, and x is 10–70; and a support for said electrothermal transducer.

31. A substrate for ink jet head according to claim 30, wherein said amorphous alloy is represented by $$M_x(Fe_{100-y-z}Ni_yCr_z)_{100-x}$$

wherein M is at least one selected from Ti, Zr, Hf, Nb, Ta and W and x is 20–70.

32. A substrate for ink jet head according to claim 30, wherein said amorphous alloy is $Ta_{50}(Fe_{73}Ni_{10}Cr_{17})_{50}$.

33. A substrate for ink jet head according to claim 30, wherein said amorphous alloy is $Ti_{25}(Fe_{73}Ni_{10}Cr_{17})_{75}$.

34. A substrate for ink jet head according to claim 30, wherein said amorphous alloy is $Zr_{28}(Fe_{73}Ni_{10}Cr_{17})_{72}$.

35. A substrate for ink jet head according to claim 30, wherein said amorphous alloy is $Hf_{28}(Fe_{73}Ni_{10}Cr_{17})_{72}$.

36. A substrate for ink jet head according to claim 30, wherein said amorphous alloy is $Nb_{56}(Fe_{68}Ni_{11}Cr_{21})_{44}$.

37. A substrate for ink jet head according to claim 30, wherein said amorphous alloy is $W_{31}(Fe_{68}Ni_{11}Cr_{21})_{69}$.

38. A substrate for ink jet head according to claim 30, wherein said amorphous alloy is $Ta_{32}Ti_{18}(Fe_{73}Ni_{10}Cr_{17})_{50}$.

39. A substrate for ink jet head according to claim 30, wherein said amorphous alloy is $Nb_{28}Zr_{20}(Fe_{73}Ni_{10}Cr_{17})_{52}$.

40. A substrate for ink jet head according to claim 30, wherein said amorphous alloy is $Hf_{35}W_{22}(Fe_{73}Ni_{10}Cr_{17})_{43}$.

41. A substrate for ink jet head according to claim 30, wherein said amorphous alloy is $Ta_{40}Ti_{13}Nb_{11}(Fe_{73}N_{10}Cr_{17})_{36}$.

42. A substrate for ink jet head according to claim 30, wherein the specific resistance of said amorphous alloy is 150~300 μohm.cm.

43. A substrate for ink jet head according to claim 30, wherein said heat-generating resistor is formed between said support and said electrode.

44. A substrate for ink jet head according to claim 30, wherein said electrode is formed between said support and said heat-generating resistor.

45. A substrate for ink jet head according to claim 30, wherein said protective layer is formed on said electrothermal transducer.

46. A substrate for ink jet head according to claim 45, wherein said protective layer is formed by use of $SiO_2$.

47. A substrate for ink jet head according to claim 45, wherein said protective layer is formed by use of SiN.

48. An ink jet head substrate comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, wherein said amorphous alloy is represented by $$M_x(Fe_{100-y-z}Ni_yCr_z)_{100-x}$$

wherein M is at least one selected from Ti, Zr, Hf, Nb, Ta and W, and y is 5-30; and a support for said electrothermal transducer.

49. An ink jet head substrate comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, wherein said amorphous alloy is represented by $$M_x(Fe_{100-y-z}Ni_yCr_z)_{100-x}$$

wherein M is at least one selected from Ti, Zr, Hf, Nb, Ta and W, and z is 10-30; and a support for said electrothermal transducer.

50. An ink jet apparatus comprising an ink jet head, said ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and x is 10-30;

a support for said electrothermal transducer; and a liquid path formed on said support corresponding to the heat-generating portion of said electrothermal transducer, said liquid path communicating with a discharge opening for discharging liquid.

51. An ink jet apparatus according to claim 50, further comprising a power switch.

52. An ink jet apparatus comprising ink jet head, said ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, said heat generating portion being formed between said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and y is 5-30;

a support for said electrothermal transducer; and a liquid path formed on said support corresponding to the heat-generating portion of said electrothermal transducer, said liquid path communicating with a discharge opening for discharging liquid.

53. An ink jet apparatus according to claim 52, further comprising a power switch.

54. An ink jet apparatus comprising an ink jet head, said ink jet head comprising:

an electrothermal transducer having a heat-generating resistor of an amorphous alloy containing at least one selected from the group consisting of Ti, Zr, Hf, Nb, Ta, W, Fe, Ni and Cr and a pair of electrodes connected electrically to said heat-generating resistor, a heat generating resistor being formed in said heat generating resistor said pair of electrodes wherein said amorphous alloy is represented by $$M_x(Fe_{100-y-z}Ni_yCr_z)_{100-x}$$

wherein M is at least one selected from Ti, Zr, Hf, Nb, Ta and W, and z is 10-30;

a support for said electrothermal transducer; and a liquid path formed on said support corresponding to the heat-generating portion of said electrothermal transducer, said liquid path being formed between said pair of electrodes and communicating with a discharge opening for discharging liquid.

55. An ink jet apparatus according to claim 54, further comprising a power switch.

56. An ink jet head according to claim 54, wherein said protective layer is formed on said electrothermal transducer.

57. An ink jet head according to claim 56, wherein said protective layer is formed by use of $SiO_2$.

58. An ink jet head according to claim 56, wherein said protective layer is formed by use of SiN.

59. An ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and x is 10–30;

a support for said electrothermal transducer; and a liquid path formed on said support corresponding to the heat-generating portion of said electrothermal transducer, said liquid path communicating with a discharge opening for discharging liquid.

60. An ink jet head according to claim 59, wherein said alloy is represented by $$M_x(Fe_{100-y-z}Ni_yCr_z)_{100-x}$$

wherein M is at least one selected from Ti, Zr, Hf, Nb, Ta and W, and x is 20–70.

61. An ink jet head according to claim 59, wherein said alloy is $Ta_{50}(Fe_{73}Ni_{10}Cr_{17})_{50}$.

62. An ink jet head according to claim 59, wherein said alloy is $Ti_{25}(Fe_{73}Ni_{10}Cr_{17})_{75}$.

63. An ink jet head according to claim 59, wherein said alloy is $Zr_{28}(Fe_{73}Ni_{10}Cr_{17})_{72}$.

64. An ink jet head according to claim 59, wherein said alloy is $Hf_{28}(Fe_{73}Ni_{10}Cr_{17})_{72}$.

65. An ink jet head according to claim 59, wherein said alloy is $Nb_{56}(Fe_{68}Ni_{11}Cr_{21})_{44}$.

66. An ink jet head according to claim 59, wherein said alloy is $W_{31}(Fe_{68}Ni_{11}Cr_{21})_{69}$.

67. An ink jet head according to claim 59, wherein said alloy is $Ta_{32}Ti_{18}(Fe_{73}Ni_{10}Cr_{17})_{50}$.

68. An ink jet head according to claim 59, wherein said alloy is $Nb_{28}Zr_{20}(Fe_{73}Ni_{10}Cr_{17})_{52}$.

69. An ink jet head according to claim 59, wherein said alloy is $Hf_{35}W_{22}(Fe_{73}Ni_{10}Cr_{17})_{43}$.

70. An ink jet head according to claim 59, wherein said alloy is $Ta_{40}Ti_{13}Nb_{11}(Fe_{73}Ni_{10}Cr_{17})_{36}$.

71. An ink jet head according to claim 59, wherein the specific resistance of said heat-generating resistor is 150–300 μohm.cm.

72. An ink jet head according to claim 59, wherein said heat-generating resistor is formed between said support and said electrode.

73. An ink jet head according to claim 59, wherein said electrode is formed between said support and said heat-generating resistor.

74. An ink jet head according to claim 59, wherein said electrothermal transducer generates heat energy used for discharging liquid.

75. An ink jet head according to claim 59, wherein the direction of liquid discharge from said discharge opening is substantially same as the direction of ink supply to said heat-generating portion.

76. An ink jet head according to claim 59, wherein the direction of liquid discharge from said discharge opening is different from the direction of ink supply to said heat-generating portion.

77. An ink jet head according to claim 76, wherein said two direction form substantially right angle.

78. An ink jet head according to claim 59, wherein said discharge opening is provided in a plural number.

79. An ink jet head according to claim 59, wherein said discharge opening is provided in a plurality number corresponding to the width of recording medium.

80. An ink jet head according to claim 59, wherein the member for forming said liquid path on said support is a covering member having a groove for forming said liquid path.

81. An ink jet head according to claim 59, wherein the member for forming said liquid path on said support comprises a wall-forming member forming the wall of said liquid path and a top plate bonded to said wall-forming member.

82. An ink jet head according to claim 81, wherein said wall-forming member is formed using a photosensitive resin.

83. A substrate for ink jet head according to claim 59, wherein said protective layer is formed by use of SiN.

84. An ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and y is 5–30;

a support for said electrothermal transducer; and a liquid path formed on said support corresponding to the heat-generating portion of said electrothermal transducer, said liquid path communicating with a discharge opening for discharging liquid.

85. An ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and z is 10–30;

a support for said electrothermal transducer; and a liquid path formed on said support corresponding to the heat-generating portion of said electrothermal transducer, said liquid path communicating with a discharge opening for discharging liquid.

86. An ink jet head substrate comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, wherein said alloy is represented by $$M_x(Fe_{100-y-z}Ni_yCr_z)_{100-x}$$

wherein M is at least one selected from Ti, Zr, Hf, Nb, Ta and W, and x is 10–70; and a support for said electrothermal transducer.

87. A substrate for liquid jet head according to claim 86, wherein said alloy is represented by $$M_x(Fe_{100-y-z}Ni_yCr_z)_{100-x}$$

wherein M is at least one selected from Ti, Zr, Hf, Nb, Ta and W and x is 20–70.

88. A substrate for ink jet head according to claim 86, wherein said alloy is $Ta_{50}(Fe_{73}Ni_{10}Cr_{17})_{50}$.

89. A substrate for ink jet head according to claim 86, wherein said alloy is $Ti_{25}(Fe_{73}Ni_{10}Cr_{17})_{75}$.

90. A substrate for ink jet head according to claim 86, wherein said alloy is $Zr_{28}(Fe_{73}Ni_{10}Cr_{17})_{72}$.

91. A substrate for ink jet head according to claim 86, wherein said alloy is $Hf_{28}(Fe_{73}Ni_{10}Cr_{17})_{72}$.

92. A substrate for ink jet head according to claim 86, wherein said alloy is $Nb_{56}(Fe_{68}Ni_{11}Cr_{21})_{44}$.

93. A substrate for ink jet head according to claim 86, wherein said alloy is $W_{31}(Fe_{68}Ni_{11}Cr_{21})_{69}$.

94. A substrate for ink jet head according to claim 86, wherein said alloy is $Ta_{32}Ti_{18}(Fe_{73}Ni_{10}Cr_{17})_{50}$.

95. A substrate for ink jet head according to claim 86, wherein said alloy is $Nb_{28}Zr_{20}(Fe_{73}Ni_{10}Cr_{17})_{52}$.

96. A substrate for ink jet head according to claim 86, wherein said alloy is $Hf_{35}W_{22}(Fe_{73}Ni_{10}Cr_{17})_{43}$.

97. A substrate for ink jet head according to claim 86, wherein said alloy is $Ta_{40}Ti_{13}Nb_{11}(Fe_{73}Ni_{10}Cr_{17})_{36}$.

98. A substrate for ink jet head according to claim 86, wherein the specific resistance of said alloy is 150~300 μohm.cm.

99. A substrate for ink jet head according to claim 86, wherein said heat-generating resistor is formed between said support and said electrode.

100. A substrate for ink jet head according to claim 86, wherein said electrode is formed between said support and said heat-generating resistor.

101. A substrate for ink jet head according to claim 86, wherein said protective layer is formed on said electrothermal transducer.

102. A substrate for ink jet head according to claim 101, wherein said protective layer is formed by use of $SiO_2$.

103. An ink jet head substrate comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, wherein said alloy is represented by $$M_x(Fe_{100-y-z}Ni_yCr_z)_{100-x}$$

wherein M is at least one selected from Ti, Zr, Hf, Nb, Ta and W, and y is 5–30; and a support for said electrothermal transducer.

104. An ink jet head substrate comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, wherein said alloy is represented by $$M_x(Fe_{100-y-z}Ni_yCr_z)_{100-x}$$

wherein M is at least one selected from Ti, Zr, Hf, Nb, Ta and W, and z is 10–30; and a support for said electrothermal transducer.

105. An ink jet apparatus comprising an ink jet head, said ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and x is 10–30;

a support for said electrothermal transducer; and a liquid path formed on said support corresponding to the heat-generating portion of said electrothermal transducer, said liquid path communicating with a discharge opening for discharging liquid.

106. An ink jet apparatus according to claim 105, further comprising a power switch.

107. An ink jet apparatus comprising ink jet head, said ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and y is 5–30;

a support for said electrothermal transducer; and a liquid path formed on said support corresponding to the heat-generating portion of said electrothermal transducer, said liquid path communicating with a discharge opening for discharging liquid.

108. An ink jet apparatus according to claim 107, further comprising a power switch.

109. An ink jet apparatus comprising an ink jet head, said ink jet head comprising:

an electrothermal transducer having a heat-generating resistor of an alloy containing at least one selected from the group consisting of Ti, Zr, Hf, Nb, Ta, W, Fe, Ni and Cr and a pair of electrodes connected electrically to said heat-generating resistor, a heat-generating portion being formed in said heat generating resistor between said pair of electrodes wherein said alloy is represented by $$M_x(Fe_{100-y-z}Ni_yCr_z)_{100-x}$$

wherein M is at least one selected from Ti, Zr, Hf, Nb, Ta and W, and z is 10–30;

a support for said electrothermal transducer; and a liquid path formed on said support corresponding to the heat-generating portion of said electrothermal transducer, said liquid path communicating with a discharge opening for discharging liquid.

110. An ink jet apparatus according to claim 109, further comprising a power switch.

* * * * *

UNITED STATES PATENT AND TRADEMARK OFFICE

CERTIFICATE OF CORRECTION

PATENT NO. : 5,113,203

DATED : May 12, 1992

INVENTOR(S) : HIROSHI TAKAGI, ET AL.

It is certified that error appears in the above-identified patent and that said Letters Patent is hereby corrected as shown below:

COLUMN 1

Line 47, "of the" (first occurrence) should be deleted.
Line 57, "layer" should read --layers--.

COLUMN 2

Line 3, "of" (second occurrence) should read --or--.
Line 13, "dischargigng" should read --discharging--.
Line 17, "Whereas, no" should read --No--.

COLUMN 5

Line 29, "was" should read --were--.
Line 64, "Example" should read --Examples--.

COLUMN 6

Line 41, "heat generating" should read --heat-generating--.

COLUMN 7

Line 66, "heat generating" should read --heat-generating--.

COLUMN 8

Line 18, "heat generating" should read --heat-generating--.

UNITED STATES PATENT AND TRADEMARK OFFICE

CERTIFICATE OF CORRECTION

PATENT NO. : 5,113,203

DATED : May 12, 1992

INVENTOR(S) : HIROSHI TAKAGI, ET AL.

It is certified that error appears in the above-identified patent and that said Letters Patent is hereby corrected as shown below:

COLUMN 9

Line 63, "heat generating" should read --heat-generating--.

COLUMN 10

Line 17, "heat generating" should read --heat-generating--.
Line 39, "heat generating resistor" should read --heat-generating portion--.
Line 40, "heat generating resistor said" should read --heat-generating resistor between said--.
Line 51, "being formed between" should be deleted.
Line 52, "said pair of electrodes and" should be deleted.

COLUMN 11

Line 1, "heat" should read --heat- --.
Line 61, "direction" should read --directions--.

COLUMN 12

Line 19, "heat" should read --heat- --.
Line 39, "heat" should read --heat- --.

UNITED STATES PATENT AND TRADEMARK OFFICE

CERTIFICATE OF CORRECTION

PATENT NO. : 5,113,203

DATED : May 12, 1992

INVENTOR(S) : HIROSHI TAKAGI, ET AL.

It is certified that error appears in the above-identified patent and that said Letters Patent is hereby corrected as shown below:

COLUMN 14

Line 8, "heat" should read --heat- --.
Line 30, "heat" should read --heat- --.
Line 52, "heat" should read --heat- --.

Signed and Sealed this

Fourteenth Day of December, 1993

Bruce Lehman

*Attest:*

BRUCE LEHMAN

*Attesting Officer*

*Commissioner of Patents and Trademarks*